US007121383B2

(12) United States Patent
Kumar et al.

(10) Patent No.: US 7,121,383 B2
(45) **Date of Patent: *Oct. 17, 2006**

(54) WAYSIDE RAIL LUBRICATION APPARATUS AND METHOD

(75) Inventors: Ajith Kuttannair Kumar, Erie, PA (US); Bret Dwayne Worden, Union City, PA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/054,868

(22) Filed: Feb. 10, 2005

(65) Prior Publication Data

US 2005/0145438 A1 Jul. 7, 2005

Related U.S. Application Data

(63) Continuation of application No. 10/023,246, filed on Dec. 17, 2001, now Pat. No. 6,854,563.

(51) Int. Cl.
*B61K 3/00* (2006.01)

(52) U.S. Cl. ..... 184/3.1

(58) Field of Classification Search ..... 184/3.1, 184/3.2

See application file for complete search history.

(56) References Cited

U.S. PATENT DOCUMENTS

| | | | |
|---|---|---|---|
| 4,214,647 | A | 7/1980 | Lutts |
| 4,230,045 | A | 10/1980 | Fearon |
| 4,245,719 | A | 1/1981 | Frank |
| 4,334,596 | A | 6/1982 | Lounsberry, Jr. |
| 4,346,785 | A | 8/1982 | Frank |
| 4,489,809 | A | 12/1984 | Wade |
| 4,520,901 | A | 6/1985 | Borup et al. |
| 4,556,127 | A | 12/1985 | Doorley et al. |
| 4,726,448 | A | 2/1988 | Schroeder et al. |
| 4,834,218 | A | 5/1989 | Dombroski et al. |
| 4,856,617 | A | 8/1989 | Lounsberry, III et al. |
| 4,930,600 | A | 6/1990 | Kumar et al. |
| 5,076,396 | A | 12/1991 | Foote |
| 5,251,724 | A | 10/1993 | Szatkowski et al. |
| 5,348,120 | A | 9/1994 | Junk et al. |

(Continued)

FOREIGN PATENT DOCUMENTS

| | | |
|---|---|---|
| DE | 19549219 C1 | 12/1995 |

*Primary Examiner*—Chong H. Kim
(74) *Attorney, Agent, or Firm*—Carlos Luis Hanze; David G. Maire; Beusse Wolter Sanks Mora & Maire, PA

(57) ABSTRACT

A wayside lubrication apparatus (10) for applying a lubricant (26) in response to the presence of a train (14) on the rail (14). To avoid excessive lubricant on the rail, lubricant may be applied in response to a second train only if a predetermined time period has elapsed between first and second trains. The amount of lubricant applied in response to the second train may be controlled by refilling a lubricant container (68) at a controlled rate. The application of lubricant may be terminated before a number of rearmost load cars (46) of the train pass the lubricant applicator (28) so that the quantity of lubricant remaining on the rail is reduced by the wheels (40) of the cars at the end of the train. This prevents the lubricant from reducing the traction capability of the drive wheels (38) of the next oncoming locomotive (16). Operation of the lubricant dispensing apparatus (22) may be bypassed by an operator-controlled bypass device (60) located on-board the train.

3 Claims, 1 Drawing Sheet

U.S. PATENT DOCUMENTS 5,358,072 A 10/1994 Szatkowski et al.
5,477,941 A 12/1995 Kumar et al.
5,492,642 A 2/1996 Mulvihill et al.
5,687,814 A 11/1997 Craig et al.
5,722,509 A 3/1998 Clinger
5,896,947 A 4/1999 Kumar
5,992,568 A 11/1999 Craig et al.
6,009,978 A 1/2000 Chisholm
6,136,757 A 10/2000 Chiddick
6,170,610 B1 1/2001 Kumar
6,182,793 B1 2/2001 Jamison
6,186,411 B1 2/2001 Sich
6,199,661 B1 3/2001 Kumar
6,446,754 B1 9/2002 Kostelny-Vogts et al.
6,585,085 B1 7/2003 Kumar
2002/0056592 A1 5/2002 Arens et al.

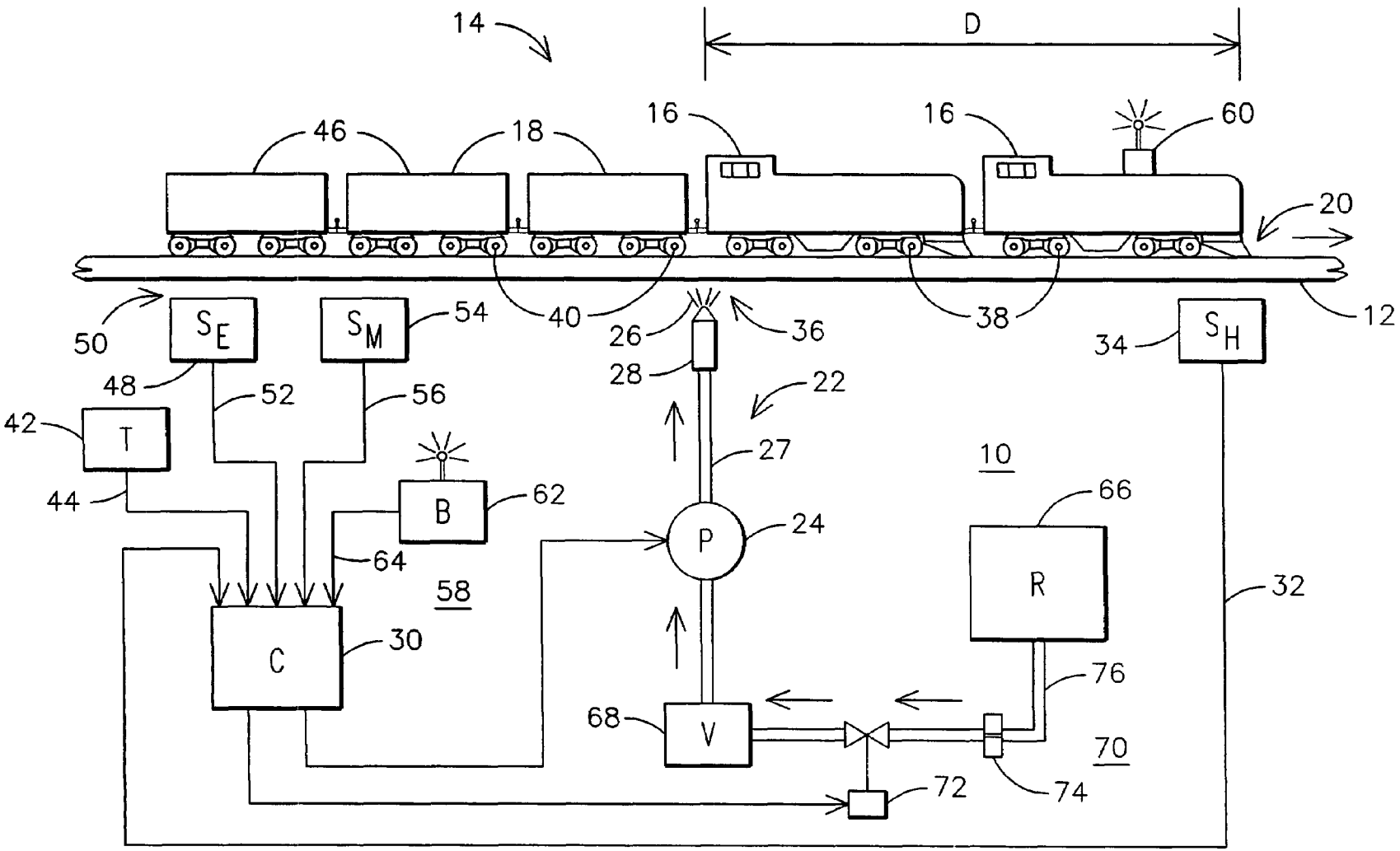
D
14
16
16
18
46
60
20
12
50
38
40
36
26
28
22
27
24
P
V
68
72
74
76
70
66
R
10
32
34
$S_H$
62
B
58
54
$S_M$
56
52
$S_E$
48
T
42
44
64
30
C

WAYSIDE RAIL LUBRICATION APPARATUS AND METHOD

RELATED APPLICATION

This application is a continuation of U.S. patent application Ser. No. 10/023,246 filed 17 Dec. 2001, scheduled to issue as U.S. Pat. No. 6,854,563 on 15 Feb. 2005.

FIELD OF THE INVENTION

This invention relates generally to the field of rail transportation, and more particularly to the field of rail lubrication systems, and specifically to a wayside rail lubrication apparatus and method.

BACKGROUND OF THE INVENTION

A typical train includes one or more locomotives pulling a plurality of load cars. Each vehicle in the train includes a plurality of metal wheels that roll along the metal rail as the train is propelled along the track. The rolling contact between the wheel and the rail provides an efficient mode of transportation, particularly for heavy loads. Proper interaction between the wheel and the rail is critical for safe, reliable, efficient operation of the train.

A rail includes a bottom mounting flange, a top railhead that makes contact with the vehicle wheel, and a flange interconnecting the flange and the railhead. A vehicle wheel includes a center hub mounted onto the vehicle axle, a plate extending outwardly from the hub, and an outer rim surrounding the plate for making contact with the rail. The rim includes an outside diameter tread that may be flat or tapered and a flange extending outwardly from a back side of the tread. The tread rides along a top surface of the railhead for supporting the vertical weight of the vehicle. The flange extends along and makes contact with a side of the railhead for providing lateral support to allow the wheel to follow along the path of the railhead. Flanges are provided on only one side of each wheel along an inside of the rail. As a train negotiates a curve in the track, the flanges of the outer diameter (high side) wheels provide the lateral forces for turning the train.

Rail vehicle wheels suffer wear over time due to their contact with the rail. The treads wear as a result of their contact with the top of the rail, particularly in the event of the wheel slipping with respect to the rail during acceleration or braking events. The wheel flanges will wear due to their contact with the inside surface of the railhead, particularly on curves and through switches.

It is known in the art to provide lubrication between the wheel and the rail in order to reduce wheel wear and to provide more efficient movement of the wheel over the rail. Lubrication may be provided on the top of the rail to reduce rolling friction at any location. Flange lubrication systems are especially useful in curved areas of the track where the forces between the railhead and the flange are at their maximum. Both on-board and wayside lubrication systems are used. On-board systems are useful for applying lubricant at any location along a rail line. Wayside lubrication systems are typically installed only at curved locations of the track. In some situations, it is desirable to apply lubrication between the wheel and the flange in order to minimize wear of the flange, while at the same time it is undesirable to apply lubrication to the top of the rail because of the reduction in traction that may be generated against a lubricated rail. In general, it is desired to achieve adequate lubrication while minimizing the amount of lubricant used so that the location of the lubricant can be precisely controlled, the cost minimized, and the impact upon the surrounding environment abated.

Numerous patents have issued for systems that control the amount, timing and location of lubrication applied between a wheel and a rail. U.S. Pat. No. 6,182,793 describes an on-board lubricant delivery system that changes the rate of application with the speed of the train. U.S. Pat. No. 6,009,978 describes an on-board lubricant delivery system that applies lubrication only when the rail vehicle is on a curved section of track. U.S. Pat. No. 5,896,947 describes an on-board lubricant delivery system that applies flange lubrication at the front of a locomotive and also applies both flange lubrication and top-of-rail lubrication at the rear of the locomotive. This system controls the rate of lubrication in response to train speed, track curvature, trailing tonnage, temperature, direction of travel, status of braking, and high rail verses low rail. U.S. Pat. No. 6,199,661 describes a computer-controlled on-board lubrication system that applies a lubricant only in a quantity that will be consumed by the time the entire train has passed.

Wayside lubrication systems are commonly activated by the weight of a passing vehicle. The weight of the vehicle is sometimes used as the source of energy for pumping the lubricant, as described in U.S. Pat. Nos. 4,334,596 and 5,076,396. Known wayside lubricating systems often dispense an inappropriate amount of lubrication and/or dispense lubrication when it is not beneficial. U.S. Pat. No. 4,856,617 describes a wayside lubricating system that incorporates a test cycle to provide compensation for changes in lubricant viscosity as a function of temperature. However, further improvements to wayside lubrication systems are needed.

BRIEF DESCRIPTION OF THE DRAWING

The features and advantages of the present invention will become apparent from the following detailed description of the invention when read with the sole accompanying drawing which is a schematic illustration of a train passing over a section of rail serviced by a wayside lubrication system.

DETAILED DESCRIPTION OF THE INVENTION

A wayside lubrication apparatus 10 is shown in FIG. 1 as being installed along a rail 12 over which is passing a train 14 having two locomotives 16 and a plurality of load cars 18. The locomotives 16 at the head of the train 14 are located at a first position 20 along the rail 12, for example at the beginning of a curved section of the rail 12.

The wayside lubrication apparatus 10 includes a lubricant dispensing apparatus 22 incorporating a pump 24 for supplying a lubricant 26 to rail 12 through applicator 28. The lubricant 26 may be a petroleum or soybean based oil, a molybdenum or graphite grease or any of the specialty rail lubricants known in the art. The applicator may be a spray nozzle, mechanical wiper, dispenser tube outlet or other known mechanism.

The operation of lubricant dispensing apparatus 22 is controlled by a controller 30, although less sophisticated systems also described herein may not require the control processes utilized in the system shown in the FIGURE. Controller 30 may include a switch, relay, microprocessor, or other known form of process control device. In one embodiment, controller 30 includes machine-executable logic expressed in the form of software and/or firmware. Controller 30 functions to operate pump 24 in response to a lubrication signal 32 provided by a train head sensor (SH) 32 located proximate first position 20 of rail 12. Sensor 32 produces lubrication signal 32 in response to the presence of train 14 at first position 20 by sensing the weight of locomotive 16 or by other known method, such as optical, infrared and/or sonic technologies.

Lubricant dispensing apparatus 22 is located at a second position 36 along rail 12 that is separated from the first position 20 by a distance along rail 12 sufficient to prevent the lubricant from contacting drive wheels 38 of locomotives 16. In this manner, the lubricant 26 applied by wayside lubrication apparatus 10 will function to reduce the friction between the rail 12 and the wheels 40 of the load cars 18, but will not reduce the traction capability of the locomotive drive wheels 38. The distance D between the first 20 and second 36 position along the rail 12 may be selected to span the length of the largest locomotive consist used on the particular rail line.

In certain applications it may not be possible to separate sensor 34 and applicator 28 by a distance D sufficient to prevent lubricant 26 from contacting the locomotive drive wheels 38. For such applications, it may be desirable to include a timed delay between the generation of lubrication signal 32 and the actual start of the application of the lubricant 26 onto rail 12. A timer 42 may be incorporated into controller 30 or provided as a discrete device for providing a time signal 44 to controller 30. Logic executed by controller 30 provides that pump 24 is energized only after a predetermined time interval has elapsed after receipt of lubrication signal 32 by controller 30. In this manner, lubricant dispensing apparatus 22 will operate to provide lubricant 26 to only the wheels 40 of the load cars 18 and not to the drive wheels 38 of locomotives 16. The time interval of this embodiments functions as the equivalent to distance D described above. Furthermore, the time interval may be changed in response to other inputs received by controller 30. For example, it is possible to detect the speed of the train 14 and to correlate the speed to the time delay required to achieve an effective distance D. As the speed of the train increases, the required time delay decreases. Furthermore, it is possible to detect the type and/or number of locomotives 16 included in train 14 and to correlate such information to a required effective locomotives 16 in the consist increase, the required time delay increases.

A time delay may also be implemented by the time necessary to fill delivery tube 27 with lubricant. Delivery tube 27 may be empty of lubricant when pump 24 is first energized, and the internal volume of tube 27 will be filled before the lubricant begins to be expelled from applicator 28. To ensure that delivery tube 27 is empty when pump 24 is first energized, as drain capability may be provided.

In a further embodiment, each axle of train 14 may function to pump a small quantity of lubricant through applicator 28, either by the pumping action of the axle force on the rail or by the intermittent actuation of pump 24 in response to each axle passing a point on the rail 12. In this manner, the total quantity of lubricant applied to the rail 12 as a result of the limited number of axles of the locomotive (s) will be insufficient to effectively lubricate the rail 12. Only after a greater quantity of axles have passed over the point on the rail 12 will there be sufficient lubricant 26 to provide an effective degree of lubrication.

Time signal 44 may also be used to prevent the lubrication of rail 12 more often than is necessary to maintain a desired level of lubrication in the event of closely spaced trains 14. Lubricant 26 applied to the rail 12 will lose its effectiveness due to a number of factors, including the time period since its application. Most lubricants 26 will flow away from the desired area of the rail 12 over time as a function of the viscosity of the lubricant 26. Furthermore, many lubricants are formulated to be rapidly biodegradable in order to minimize their impact on the environment. Therefore, if a second train follows a first train 14 within a relatively short time period, no further lubrication of the rail 12 may be needed. Accordingly, controller 30 may be programmed with logic establishing a minimum time period between applications of lubricant 26 in order to conserve lubricant.

It may also be desirable to terminate the application of lubricant 26 prior to the time when all of the load cars 18 have passed the applicator 28. The wiping/cleaning action of the wheels 40 of the load cars 46 at the rear of the train 14 can function to reduce the quantity of lubricant 26 remaining on the rail 12 after the train 14 has passed in order to prevent the lubricant 26 from adversely affecting the traction performance of any following locomotives. An end of train sensor (SE) 48 may be located at a third position 50 along rail 12 to produce a train end signal 52 responsive the end of train 14 passing third position 50. Train end signal 52 is processed by controller 30 to terminate the application of lubricant 26 before a predetermined number of rear load cars 46 pass the location of the applicator 28. This process may include consideration of the speed of the train 14 and/or variables affecting the cleaning efficiency of the rear load cars 46, such as temperature for example.

Environmental conditions such as temperature, rail, snow, fog and wind may effect the performance of the lubricant 26 on the rail 12. It may be desirable to include as part of wayside lubrication apparatus 10 an environmental sensor such as moisture sensor (SM) 54 for detecting the presence of moisture on rail 12. Because water is a lubricant, it may be unnecessary to provide additional lubricant 26 when the rail 12 is wet from rain, snow or fog. A moisture signal 56 responsive to such environmental conditions may be used by controller 30 to prevent the application of lubricant 26 by the lubricant dispensing apparatus 22 in response to a predetermined environmental condition.

It may also be advantageous to provide for human intervention to prevent the application of lubricant 26 in response to the lubrication signal 32. For example, in a system not having a moisture sensor 54, it may be desirable to provide an operator on-board the train 14 with the capability of bypassing the operation of the lubricant dispensing apparatus 22 during wet operating conditions. One such bypass device 58 includes a wireless communication system transmitter 60 responsive to an operator action on-board locomotive 16 and an associated wireless communication system receiver 62 for producing a bypass signal 64 responsive to the operator action. Controller 30 may be programmed with instructions for bypassing the operation of pump 24 in spite of the presence of lubrication system receiver 62 may further be responsive to a wireless signal initiated by a central control facility or weather measuring facility (not shown) positioned at a remote location. The bypass device 58 may alternatively include a hard-wired communication device for receiving a bypass signal 64 from a remote location.

Pump 24 may draw lubricant 26 directly from a large reservoir 66, or as illustrated in the FIGURE, from a smaller lubricant container 68. Lubricant 26 is provided to the container 68 by gravity or preferably via forced flow. In order to limit the total volume of lubricant 26 that can be applied to rail 12 over a short period of time, a refilling device 70 is provided for adding lubricant 26 to the lubricant container 68 at no more than a predetermined rate. The refilling device 70 may include a controlled flow pump (not shown), a valve 72 controlled by controller 30, and/or an orifice 74 located in a lubricant container refilling line 76. Any one or combination of such devices function to limit the accumulation of lubricant 26 within container 68, thereby limiting the amount of lubricant 26 available for delivery to applicator 28 by pump 24. After a sufficiently long time period has elapsed since the previous lubricant application, lubricant container 68 will be completely full and a full charge of lubricant 26 can be delivered to rail 12 in response to lubrication signal 32. If the time period elapsed since the previous lubricant application is not sufficiently long, the amount of lubricant applied to rail 12 by lubricant dispensing apparatus 22 in response to the presence of a second train 14 will be correspondingly reduced from a full charge amount.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A method of applying lubricant for the passage of trains each having one or more locomotives constituting a consist, the consist located at a head of train at a leading end of the train, and an end of train at a trailing end of the train as the train travels along the rail, the method comprising:

sensing the presence of a train on a rail;

applying a lubricant at a section of the rail in response to the presence of the train;

sensing the end of train approaching the section of the rail; and terminating the application of lubricant at the section of the rail before a predetermined number of cars at the end of train pass the section of the rail so that a quantity of lubricant remaining on the section of the rail is reduced by wheels of the predetermined number of cars at the end of the train.

2. The method of claim 1, further comprising:

detecting the end of the train proximate a position of the rail a predetermined distance from a position of a lubricant applicator; and terminating application of the lubricant by the lubricant applicator in response to the detection of the end of the train.

3. A wayside rail lubrication apparatus for applying lubricant for the passage of trains along a rail, the apparatus comprising:

a lubricant dispensing apparatus disposed at a lubrication position along a rail for applying lubricant in response to the presence of a train;

an end of train sensor producing an end of train signal upon detecting an end of the train at a location up-rail of the lubricant dispensing apparatus relative to a direction of travel of the train; and a controller responsive to terminate the application of lubricant by the lubricant dispensing apparatus upon receipt of the end of train signal before the end of train passes the lubrication position so that a quantity of lubricant remaining on the rail is reduced by wheels of rear load cars of the train.

* * * * *